US005390978A

United States Patent [19]

Janisch

[11] Patent Number: 5,390,978

[45] Date of Patent: Feb. 21, 1995

[54] ROTATABLE AND DISPLACEABLE SEAT

[75] Inventor: Klaus Janisch, Isny, Germany

[73] Assignee: Schmidt & Lenhardt GmbH & Co. oHG, Isny, Germany

[21] Appl. No.: 212,369

[22] Filed: Mar. 14, 1994

[30] Foreign Application Priority Data

Mar. 16, 1993 [EP] European Pat. Off. ..... 93104198
Jan. 15, 1994 [EP] European Pat. Off. ..... 94100547

[51] Int. Cl.[6] ..... A61G 7/10
[52] U.S. Cl. ..... 297/240; 297/337; 297/344.24
[58] Field of Search ..... 297/240, 242, 337, 344.21, 297/344.24; 5/81.1

[56] References Cited

U.S. PATENT DOCUMENTS 2,944,591 7/1960 Morrill, Jr. ..... 297/337 X
3,047,622 7/1962 Milner ..... 297/240
5,318,339 6/1994 Cherniak ..... 297/242 X

FOREIGN PATENT DOCUMENTS 2170700 8/1986 United Kingdom ..... 297/240

*Primary Examiner*—Peter R. Brown
*Attorney, Agent, or Firm*—Notaro & Michalos

[57] ABSTRACT

A rotary plate (14) is mounted on an oblong bottom plate (12) in a manner which permits the former's longitudinal displacement.

The bottom plate (12) features a number of transverse grooves (46) extending over its full width, between which grooves (46) are formed articulating webs (48) at the bottom and top face of the bottom plate (12) around which articulating webs (48) adjacent strips of the bottom plate (12) can be folded relative to each another. The bottom plate (12) forms in the area of the articulating webs (48) a multi-member belt or band with a sprung flat-shape recovery action. The rotary plate (14) features a central pin (36) which can be moved from a locked position into an unlocked position and vice versa. In the locked position, the pin (36) engages in a hole (30) of the bottom plate (12) to prevent the rotary plate (14) from further displacement.

5 Claims, 2 Drawing Sheets

ROTATABLE AND DISPLACEABLE SEAT

BACKGROUND TO THE INVENTION

The invention concerns a rotatable and displaceable plate arrangement as a seating surface for physically handicapped people, with a rotary plate which is pivot-mounted on a bottom plate and guided by means of a displaceable plate provided in a sliding guideway of the oblong bottom plate for reciprocating movement between two end positions, the bottom plate being divided into several sections which are relatively foldable around axes running transverse to the longitudinal direction of said bottom plate.

Rotatable and displaceable seat arrangements of this species are known (DE-U-9113964). Here the prior-art bottom plate comprises a number of individual members, of which each is connected in a hinge-like arrangement to associated adjacent members by means of articulating pins extending over the full width of said bottom plate. As the displacement guideway is only located in the central area, two types of member must be manufactured and assembled. The result is a multi-member belt or band which is very flexible, can, for example, be rolled, and exhibits no stiffness or rigidity. However, as it adapts to any unevenness, the rotary plate cannot be displaced if the bottom plate is resting on an uneven, e.g. undulating surface. Aside from the high assembly costs, a further disadvantage lies in the fact that dirt and foreign matter can become lodged in the many articulating hinges between the members, rendering cleaning difficult. In the displacement end positions, the rotary plate cannot be secured against unwanted or accidental shift, a situation which is undesirable for handicapped persons who are standing or sitting on the rotary plate.

SUMMARY OF THE INVENTION

The object of the invention is to improve the rotatable and displaceable seat of the species mentioned above while avoiding its disadvantages.

This objective is achieved by the invention in that the bottom plate is constructed as a single-piece plastics component, and that provided between each pair of relatively foldable sections is a transverse groove emanating from the underside surface of the bottom plate and forming an articulating web, said transverse groove extending over the full width of said bottom plate.

The single-piece bottom plate is preferably manufactured in a mould as an injection-moulded component. That part of the bottom plate not occupied by the rotary plate can thus be swivelled around the articulating web out of the plane of the bottom plate. For a bath lift, the free portion of the bottom plate must be capable of being rotated steeply upwards to match the steepness of the side flaps on the seat board of said bath lift. This is achieved by virtue of the arrangement of the articulating webs in the upper face area of the bottom plate. The width of the transverse grooves also, however, permits the bottom plate to be folded downwards so enabling it to be adapted to the contour of the mattress of a hospital bed.

Experience has shown that, in each longitudinal half of the bottom plate, a group of three parallel transverse grooves ensures sufficient bottom plate foldability.

A further development of the invention exists in that the rotary plate can preferably be secured in both displacement end positions to prevent further shifting. In principle it is sufficient to provide a means of detent of the rotatable and displaceable seat in just one end position of the displacement path in said bottom plate, and also to provide for articulation in just one longitudinal half of the bottom plate. The bottom plate must then be positioned for each application to give it a certain orientation. With a mirror symmetry of the two longitudinal halves of the bottom plate, the necessity to ensure correct orientation during the positioning operation is eliminated.

BRIEF DESCRIPTION OF THE DRAWINGS

The invention is described in greater detail on the basis of the drawing which depicts an embodiment of the invention, whereby.

DETAILED DESCRIPTION

Figure 1:
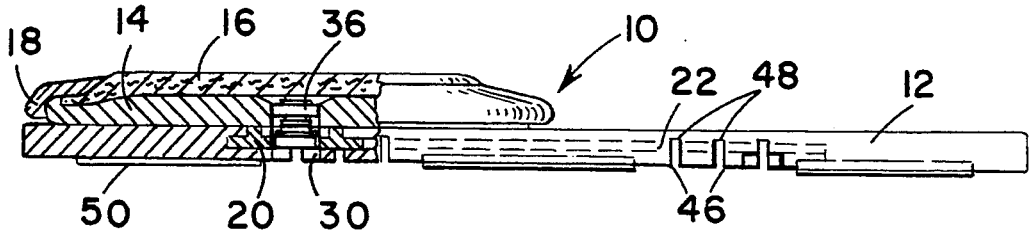
FIG. 1 shows a partially cut-away longitudinal view of the rotatable and displaceable seat.
Figure 2:
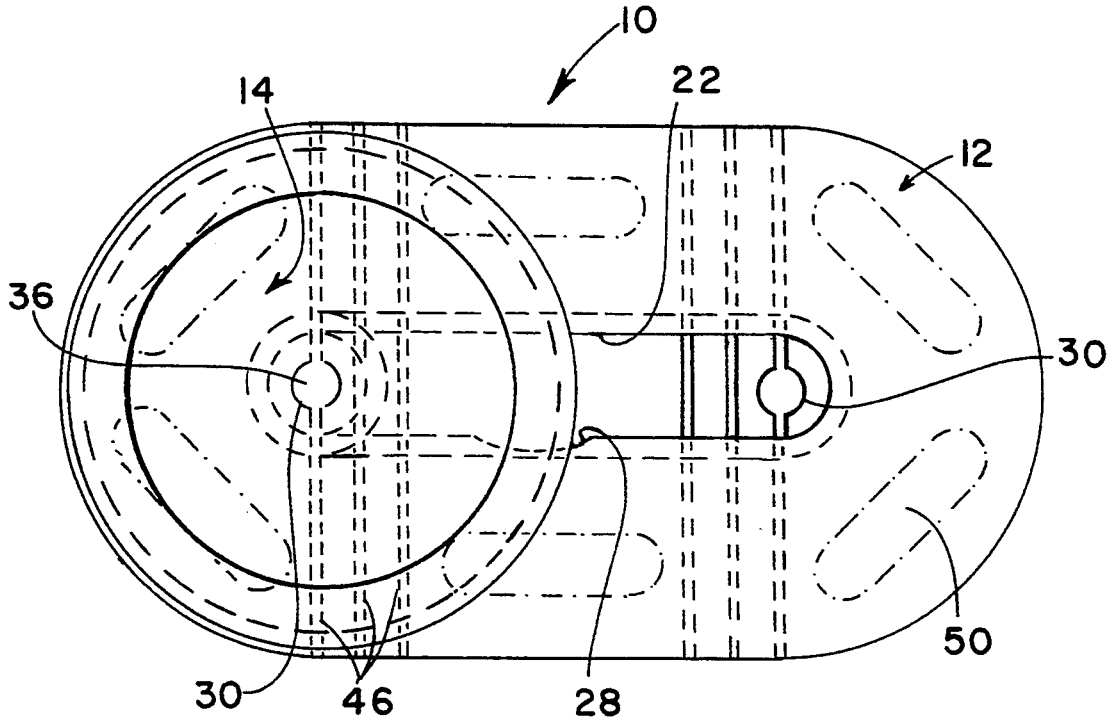
FIG. 2 shows a top view of the rotatable and displaceable seat.

A rotatable and displaceable seat arrangement 10 features a bottom plate 12, a rotary plate 14 with upholstery pad 16, and a retaining ring 18. Secured to the underside of the rotary plate 14 is a displaceable plate 20. In principle, the rotary plate 14 and displaceable plate 20 could also be of single-piece construction. The bottom plate 12 is of oblong shape and is contoured with two semicircular curves and straight elements connecting these. The diameter of the semicircular curves corresponds to that of the rotary plate 14 with the retaining ring 18 fitted. Viewed from the top, the bottom plate 12 features a guideway 22 open at the top, which in turn features a T-groove cross section. In this guideway 22, the displaceable plate of circular contour can be rotated and shifted. The displaceable plate 20 has at the top a diameter equivalent to the clear width of the guideway 22. In the bottom half, the displaceable plate 20 features an external flange 24 which engages in an open recess 26 running around the bottom plate 12. The displaceable plate is secured by screws 28 to the bottom of the rotary plate 14. In the centre of the guideway 22 is located on one side in the upper wall area a recess 28 (FIG. 2) which serves to facilitate introduction of the displaceable plate 20 in the guideway 22. Within the guideway 22 there is a hole 30 at both ends provided in the bottom plate 12. The holes 30 are located along the longitudinal centreline plane and lie concentric to the semicircular contours of the bottom plate 12.

The rotary plate 14 and the displaceable plate 20 have through-bores 32, 34 of the same diameter which are flush with each other. These through-bores 32, 34 lie coaxial to the rotational axis of the rotary plate 14. In the two displacement end positions of the rotary plate 14, the pair of through-bores 32, 34 are flush with the respective hole 30 in the bottom plate 12. Located in the bore arrangement 32, 34 is a pin 36 which is axially displaceable. In its mid-zone area, the pin 36 exhibits two axially spaced circumferential grooves 38. Two pairs of opposing recesses 40 are provided in the top of the displaceable plate 20, in which the ends of wire springs 42 are located. Each pair of recesses 40 is interconnected by a recess 44 of the same depth as recesses 40. The transverse distance between the two recess pairs 40, 40 is somewhat less than the core diameter of the pin 36 in the area of the annular grooves 38. The wire springs 42 engage with a light preload in either one or the other groove 38.

Figure 3:
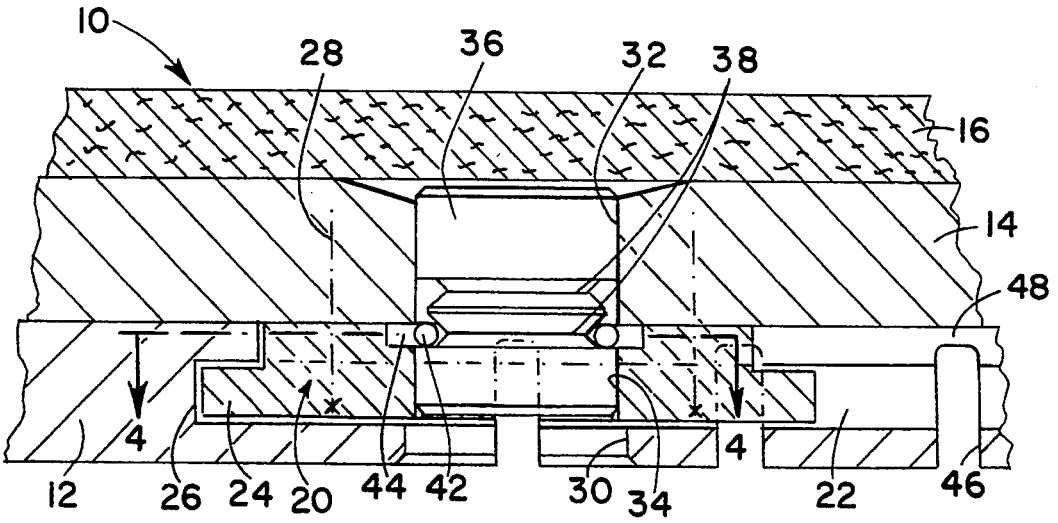
FIG. 3 shows an enlarged sectional view of the central detent device of the rotatable and displaceable seat.
Figure 4:
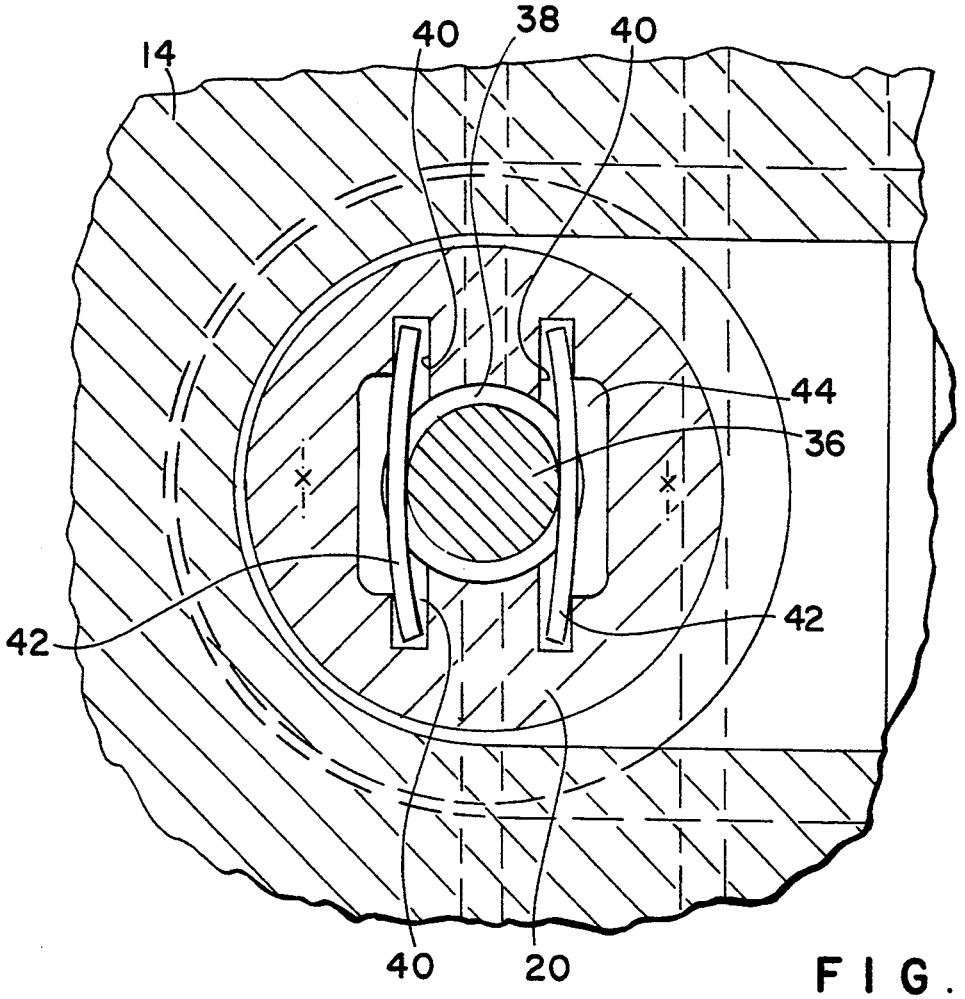
FIG. 4 shows a horizontal sectional view along the line 4—4 of FIG. 3.

The pin 36 is shown in FIG. 3 in its unlocked position. If a downward pressure is applied to the pad 16 in the central area of the rotary plate 14, the wire springs 42 deflect outwards as a result of the V-shaped contour of the annular grooves 38 and into the recesses 44. The pin can then move downwards until the wire springs 42 engage in the top annular groove 38. The bottom end of the pin 36 has then entered the hole 30 in the bottom plate 12, and the rotary plate 14 is locked in the appropriate end position of the bottom plate 12 such that it is prevented from further displacement. As the hole 30 is open at the bottom, the application of an appropriate finger pressure from below will push the pin 36 upwards back into its unlocked position in which it is again detained.

The bottom plate 12 features in each longitudinal half a group of three parallel transverse grooves 46 which extend over the full width of said bottom plate 12, and extend from the underside over virtually the full thickness of said bottom plate 12, leaving just thin articulating webs 48 in the top section of the bottom plate. By means of these articulating webs 48, that portion of the bottom plate 12 not occupied by the rotary plate 14 can be folded upwards and downwards. The degree of bend downwards is limited by the width of the transverse grooves 46. In the upward direction, the bending angle is unlimited. The free portion of the bottom plate 12 can thus, for example, be bent at right angles to the other portion of the bottom plate.

Arranged on the underside of the bottom plate 12 are several anti-slip strips 50 which are preferably positively located in corresponding underside recesses of said bottom plate 12.

I claim:

1. Rotatable and displaceable plate arrangement as a seating surface for physically handicapped people, with a rotary plate (14) which is pivot-mounted on an oblong bottom plate (12) and guided by means of a displaceable plate (20) provided in a sliding guideway (22) of the oblong bottom plate (12) for reciprocating movement between two end positions, the bottom plate (12) being divided into several sections which are relatively foldable around axes running transverse to the longitudinal direction of said bottom plate (12), characterised in that the bottom plate (12) is constructed as a single-piece plastics component, and that provided between each pair of relatively foldable sections is a transverse groove (46) emanating from the underside surface of the bottom plate (12) and forming an articulating web (48), said transverse groove (46) extending over the full width of said bottom plate (12).

2. Rotatable and displaceable seat according to claim 1, characterised in that the articulating webs (48) lie at the upper face of the bottom plate (12).

3. Rotatable and displaceable seat according to claim 1, characterised in that, in each longitudinal half of the bottom plate (12) is provided a group of three parallel transverse grooves (46).

4. Rotatable and displaceable seat according to claim 1, characterised in that a pin (36) is provided in a hole arrangement (32, 34) passing through the rotary plate (14) and the displaceable plate (20) coaxial to the rotary axis, said pin being mounted for axial displacement, and in at least one of the two end positions of the rotary plate (14) can be axially inserted in a clearance fit hole (30) located in the bottom plate (12).

5. Rotatable and displaceable seat according to claim 4 characterised in that the pin (36) has two end faces and is axially displaceable between two latch positions in either of which it is retained by a spring means mounted in said hole arrangement (42), and that the two end faces of the pin (36) form finger-actuation surfaces.

* * * * *